US005711662A

United States Patent [19]

Ishiguro

[11] Patent Number: 5,711,662

[45] Date of Patent: Jan. 27, 1998

[54] GAS LIGHTER

[75] Inventor: Kunio Ishiguro, Tokyo, Japan

[73] Assignee: Ishimitsu Kinzoku Kogyo Co., Ltd., Tokyo, Japan

[21] Appl. No.: 708,488

[22] Filed: Sep. 5, 1996

[30] Foreign Application Priority Data

Sep. 8, 1995 [JP] Japan ..... 7-231451

[51] Int. Cl.[6] ..... F23D 14/28

[52] U.S. Cl. ..... 431/344; 239/552; 239/568

[58] Field of Search ..... 431/344, 353, 431/150, 151, 143, 129, 130, 254, 255, 258, 267, 273, 277; 239/552, 568

[56] References Cited

U.S. PATENT DOCUMENTS 4,639,214 1/1987 Ainoz ..... 431/344

FOREIGN PATENT DOCUMENTS 6-19233 3/1994 Japan .

*Primary Examiner*—James C. Yeung

*Attorney, Agent, or Firm*—Darby & Darby

[57] ABSTRACT

A gas lighter capable of producing a flat flame so that the upper surface of the lighter body is not heated. A burner head 1 is projected columnarly from a lighter body 2. Two gas nozzles 4 open toward symmetric positions on the upper surface of the burner head 1, the upper surface being spaced from the lighter body 2. The nozzles are branched right and left at the same angle with respect to the axis of the burner head 1. A large and flat flame 5 is thus formed large and flat on the burner spaced from the lighter body 2.

7 Claims, 3 Drawing Sheets

GAS LIGHTER

BACKGROUND OF THE INVENTION

1. Field of the Invention:

The present invention relates to a gas lighter capable of generating a flat flame for a cigar.

2. Prior Art:

Gas lighters which produce a flat flame, such as the gas jet structure shown in FIG.4. In the lighter of FIG. 4, gas nozzles 20 are opened in symmetrical positions on the peripheral surface of a burner head 21 (Japanese Patent Publication No. Hei 6-19233).

In the conventional gas lighter, however, as illustrated in FIG. 4, the gas nozzles 20 are opened in a slit shape to the peripheral surface of the burner head 21, in contact with the upper surface of a lighter body 23, and symmetrical right and left with respect to the axis of the head 21, so that during use of the lighter the lighter body 23 is heated with flame 24 and the user may get burnt by the heat.

The present invention has been designed in view of such conventional structures and it is the object of the present invention to provide a gas lighter capable of producing a flat flame free from any fear of heating the upper surface of the lighter body.

SUMMARY OF THE INVENTION

According to the construction adopted by the gas lighter of the present invention for achieving the above-mentioned object, a burner head is projected columnarly from the lighter body, and two gas nozzles, which are open toward symmetric upper surface positions of the burner head spaced from the light body, are branched right and left at the same angle with respect to the axis of the burner head from certain positions of a main hole with a gas tube inserted therein, to make a fire of a large and flat flame on top of the burner head spaced from the lighter body.

DESCRIPTION OF THE PREFERRED EMBODIMENTS

Embodiments of the present invention will be described in detail hereinunder with reference to the accompanying drawings.

Figure 1:
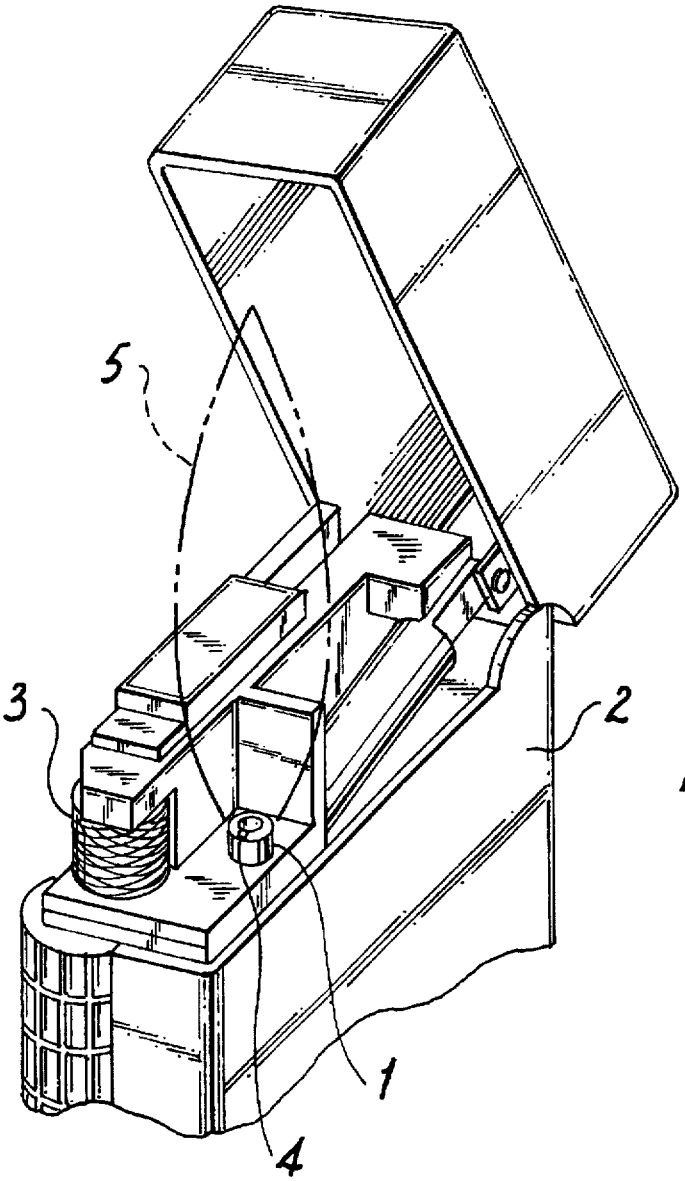
FIG.1 is a perspective view showing an upper portion of a gas lighter according to an embodiment of the present invention.
Figure 4:
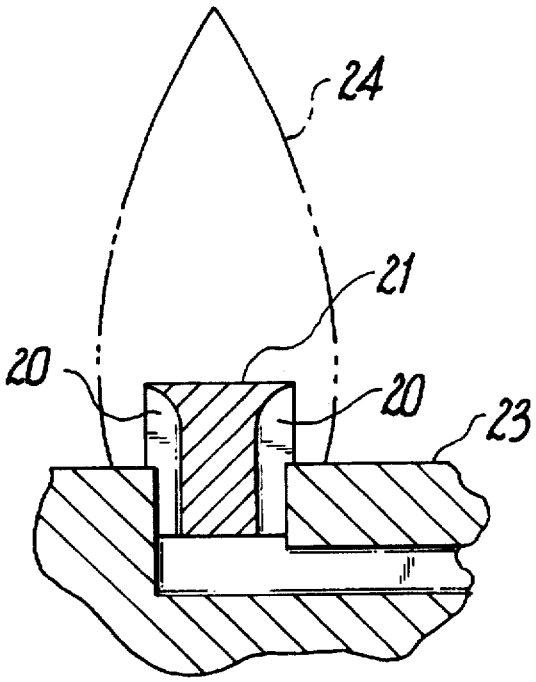
Fig. 4 (Prior Art)
FIG.4 is a sectional view showing a portion of a conventional gas lighter.
Figure 2A:
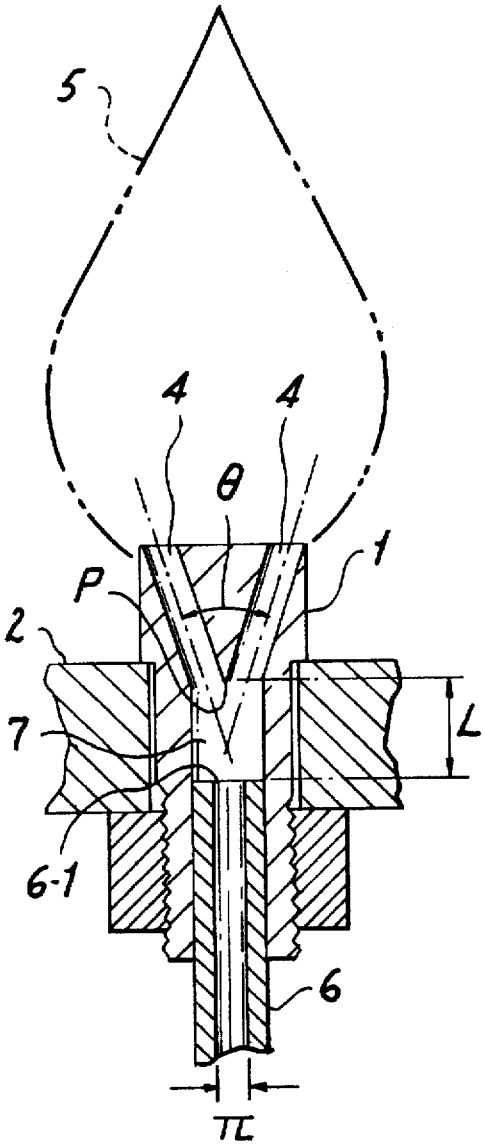
FIG.2 shows a principal portion of the gas lighter on a larger scale, in which (A) is a front view in longitudinal section, (B) is a side view in longitudinal section, and (C) is a plan view.
Figure 2B:
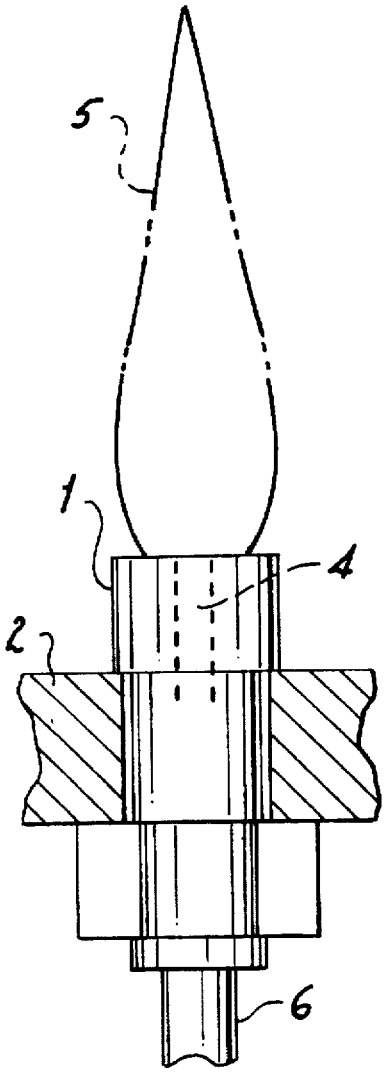
Figure 2C:
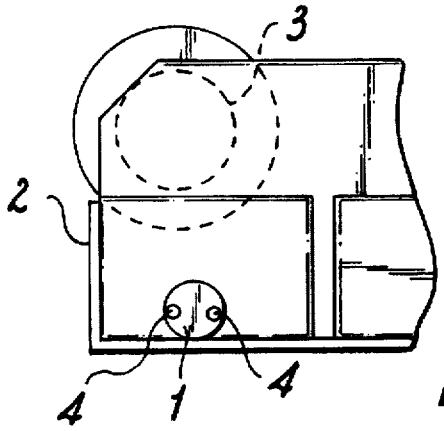

Referring to FIG.1, which is a perspective view showing an upper portion of a gas lighter embodying the invention, the numeral 1 denotes a burner head disposed projectingly in a corner position on the upper surface side of a lighter body 2, and the numeral 3 denotes a lighter flint disposed in an upper surface corner position of the lighter body 2 adjacent to the burner head 1. Upon rotation of the lighter flint 3, a flame 5 is formed large and flat from two gas nozzles 4 which are open to the upper surface of the burner head 1.

The burner head 1 is projecting from the upper surface of the lighter body 2 in a columnar shape having an appropriate height, and two gas nozzles 4 are open symmetrically right and left toward the upper surface of the burner head 1, which upper surface is flat and spaced from the lighter body 2.

The gas nozzles 4 are branched right and left at the same angle with respect to the axis of the burner head 1 from a certain position of a main hole 7 into which is inserted a vertically slidable gas tube 6, and are open to the upper surface of the burner head 1 in symmetrical right and left positions. An upward inclination angle θ of the two gas nozzles 4 which are branched and inclined right and left symmetrically with respect to the axis longitudinal of the burner head 1 is preferably in the range of 30° to 40°. It is desirable that the distance L from an end face 6-1 of the gas tube 6 inserted in the main hole 7 to a branch point P of the two gas nozzles 4 be at least three times as large as the inside diameter π of the gas tube 6, whereby the gas nozzles 4 are well balanced in the gas flow rate.

According to the gas light of this embodiment constructed as above, since the flame 5 is formed on the upper surface of the burner head 1, which upper surface is spaced from the upper surface of the lighter body 2, there is no fear of the lighter body being heated by the flame as in the conventional gas lighter. Besides, the two flames from the two gas nozzles 4 join together because the the gas nozzles are open in symmetric right and left positions at the same flat upper surface of the burner head 1. Consequently, it is possible to obtain a flame 5 having a required flat and wide shape.

Figure 3A:
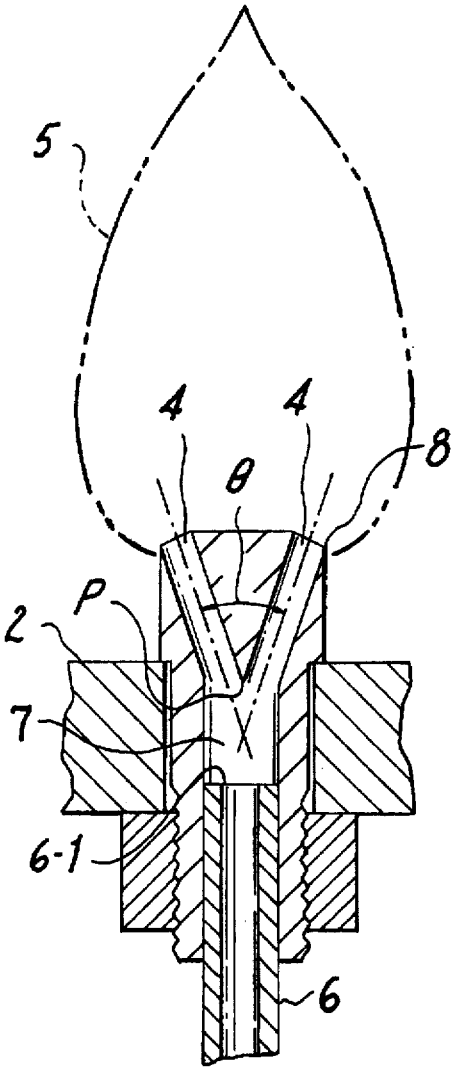
FIG.3 shows on a larger scale a principal portion of a gas lighter according to another embodiment of the present invention, in which (A) is a front view in longitudinal section, (B) is a side view in longitudinal section, and (C) is a plan view.
Figure 3B:
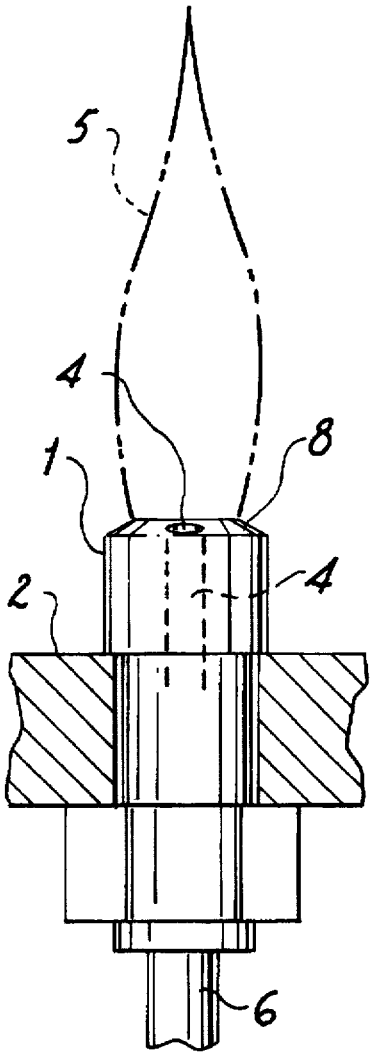
Figure 3C:
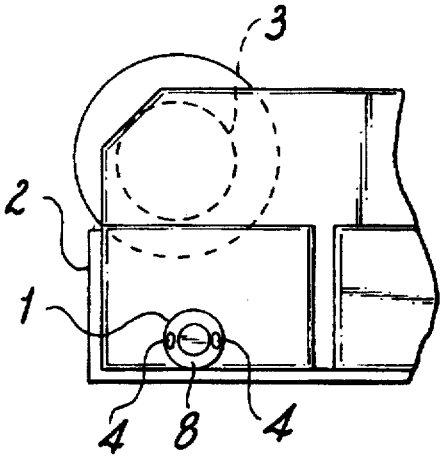

Referring now to FIG.3, there is illustrated a gas lighter according to another embodiment of the present invention, in which the upper peripheral edge of the burner head 1 set forth in the previous embodiment is chamfered and two gas nozzles 4 are open to the thus- chamfered portion indicated at 8. Such a construction permits opening (drilling) of the two gas nozzles 4. The structural elements of the lighter of FIG. 3, other than the chamfering are basically the same as in the previous embodiment. Thus, the same constructional portions as in the previous embodiment are indicated by the same reference numerals as in the previous embodiment and explanations thereof are omitted here.

The gas lighter of the present invention constructed as above exhibit the following function and effect.

Since the two gas nozzles are open to the upper surface of the burner head, which surface is spaced from the upper surface of the lighter body, the flames from the two gas nozzles are united into a single flame continually from the burner head upper surface spaced from the lighter body. Therefore, unlike the conventional gas lighter, there is no fear of the lighter body being heated by the flame. Thus, the gas lighter of the invention becomes easier to use and it is possible to obtain a flame having a flat and wide shape required for the lighting of a cigar.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

What is claimed is:

1. A gas lighter comprising:

a lighter body;

a burner head projected columnarly from said lighter body; and two gas nozzles formed in said burner head; wherein:

said burner head has an upper surface spaced from said lighter body and a longitudinal axis; and said two gas nozzles are branched right and left at the same angle with respect to said longitudinal axis of said burner head and open in said upper surface spaced from said lighter body such that a flame emanating therefrom is formed on said upper surface of said burner head, spaced from said lighter body.

2. A gas lighter as in claim 1, wherein said upper surface of said burner head is substantially flat and spaced above said lighter body.

3. A gas lighter as in claim 1, wherein said gas nozzles open upwardly away from said lighter body and away from each other so that a substantially flat flame is formed on said upper surface of said burner head spaced from said lighter body.

4. A gas lighter as in claim 1, wherein a main hole is formed in said burner head, said gas lighter further comprising a gas tube fitted within said main hole.

5. A gas lighter as in claim 4, wherein:

said gas tube has an end face facing said gas nozzles and an inside diameter;

said gas nozzles branch at a branch point; and the distance between said end face of said gas tube and said branch point is at least three times said inside diameter of said gas tube.

6. A gas lighter as in claim 1, wherein said gas nozzles are branched and inclined between approximately 30° and approximately 40° with respect to said longitudinal axis.

7. A gas lighter as in claim 1, wherein said upper surface of said burner head has a chamfered peripheral edge adjacent said nozzle openings.

* * * * *